US007036470B2

(12) United States Patent
Katayama

(10) Patent No.: US 7,036,470 B2
(45) Date of Patent: May 2, 2006

(54) FOUR-CYCLE ENGINE

(75) Inventor: Goichi Katayama, Hamamatsu (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/631,117

(22) Filed: Jul. 31, 2003

(65) Prior Publication Data

US 2004/0020456 A1 Feb. 5, 2004

(30) Foreign Application Priority Data

Jul. 31, 2002 (JP) ..... 2002-223500

(51) Int. Cl.
*F01L 1/34* (2006.01)

(52) U.S. Cl. ..... 123/90.15; 123/90.17; 123/90.31; 440/84

(58) Field of Classification Search ..... 123/90.15, 123/90.16, 90.17, 90.18, 90.27, 90.31; 464/1, 464/2, 160; 440/88, 77, 1, 84
See application file for complete search history.

(56) References Cited

U.S. PATENT DOCUMENTS

| | | | | |
|---|---|---|---|---|
| 4,685,429 | A | | 8/1987 | Oyaizu |
| 4,715,333 | A | | 12/1987 | Oyaizu |
| 4,726,331 | A | | 2/1988 | Oyaizu |
| 5,184,581 | A | | 2/1993 | Aoyama et al. |
| 5,476,402 | A | | 12/1995 | Nakai et al. |
| 5,555,869 | A | | 9/1996 | Uchida |
| 5,564,380 | A | | 10/1996 | Kobayashi et al. |
| 5,718,196 | A | | 2/1998 | Uchiyama et al. |
| 5,865,655 | A | * | 2/1999 | Hiraoka et al. ..... 440/89 |
| 5,913,298 | A | | 6/1999 | Yoshikawa |
| 5,954,019 | A | | 9/1999 | Yoshikawa et al. |
| 6,032,629 | A | | 3/2000 | Uchida |
| 6,035,817 | A | | 3/2000 | Uchida |
| 6,076,492 | A | | 6/2000 | Takahashi |
| 6,186,105 | B1 | | 2/2001 | Yonezawa |
| 6,189,498 | B1 | | 2/2001 | Yonezawa et al. |
| 6,325,031 | B1 | | 12/2001 | Takano |
| 6,343,580 | B1 | | 2/2002 | Uchida |

(Continued)

FOREIGN PATENT DOCUMENTS

JP 411132016 A 5/1999

(Continued)

OTHER PUBLICATIONS

Co-pending U.S. Appl. No. 09/878,323, filed Jun. 11, 2001, inventor: Isao Kanno, "Four-Cycle Engine For Marine Drive".

(Continued)

*Primary Examiner*—Thomas Denion
*Assistant Examiner*—Ching Chang
(74) *Attorney, Agent, or Firm*—Knobbe, Martens, Olson & Bear, LLP

(57) ABSTRACT

An engine has an engine body having an outer surface that defines an outer area next thereto. An air intake system has an intake valve movable between a closed position and an open position. An intake camshaft that actuates the intake valve extends through the engine body and toward the outer area beyond the outer surface. A drive mechanism drives the camshaft. A portion of the drive mechanism is disposed in the outer area. A hydraulically operated change mechanism changes an angular position of the camshaft relative to a crankshaft. A control valve unit controls the change mechanism. The control valve unit at least in part is disposed within the outer area.

18 Claims, 6 Drawing Sheets

U.S. PATENT DOCUMENTS

| | | | | |
|---|---|---|---|---|
| 6,439,938 | B1 | 8/2002 | Katayama | |
| 6,450,137 | B1 * | 9/2002 | Ogawa | 123/90.17 |
| 6,582,262 | B1 * | 6/2003 | Fukuda et al. | 440/88 |
| 6,672,283 | B1 * | 1/2004 | Kanno | 123/406.59 |
| 6,708,659 | B1 * | 3/2004 | Katayama | 123/90.31 |
| 2002/0014214 | A1 | 2/2002 | Katayama | |

FOREIGN PATENT DOCUMENTS

| | | | |
|---|---|---|---|
| JP | 411210425 | A | 8/1999 |
| JP | 2002-355466 | | 12/2001 |

OTHER PUBLICATIONS

Co-pending U.S. Appl. No. 09/870,618, filed May 31, 2001, inventor: Goichi Katayama, "Four-Cycle Engine For Marine Drive".

Co-pending U.S. Appl. No. 10/300,187, filed Nov. 20, 2002, inventor Goichi Katayama, "Four-Cycle Engine".

* cited by examiner

FOUR-CYCLE ENGINE

PRIORITY INFORMATION

This application is based on and claims priority to Japanese Patent Application No. 2002-223500, filed Jul. 31, 2002, the entire contents of which is hereby expressly incorporated by reference.

BACKGROUND OF THE INVENTION

1. Field of the Invention

The present invention generally relates to a four-cycle engine, and more particularly relates to a four-cycle engine having an overhead camshaft drive.

2. Description of Related Art

Four-cycle engines in outboard motors have become more common in order to control emissions more precisely. Such four-cycle engines typically comprise a crankshaft that drives a submerged marine propulsion device through suitable shaft couplings. Modern four-cycle engines typically employ an overhead camshaft drive mechanism. The camshaft drive mechanism drives at least one camshaft which actuates an intake and/or exhaust valve(s). Normally, at least one flexible transmitter e.g., a drive belt or chain that is disposed atop the engine, drives the camshaft(s).

The four-cycle engine also can have a variable valve timing (VVT) system to obtain high charging efficiency in a relatively high engine speed range and low fuel consumption and superior exhaust characteristics in a relatively low engine speed range. The VVT system can change valve timings of either the intake or exhaust valve(s) in response to the engine speeds. The VVT system can be operated hydraulically and control valve unit can control the hydraulic operation of the VVT system. Normally, the VVT system is disposed at the camshaft associated with the intake or exhaust valve(s) that needs the valve timing change. The control valve unit, more specifically, controls flow of working fluid (e.g., hydraulic fluid) in the VVT system to change an angular position of the camshaft. Such a VVT system is disclosed in, for example, Japanese Laid Open Patent Application P2001-35 5466A.

Some of the control valve units in conventional arrangements are disposed on a bearing cap that rotatably supports the camshaft on a cylinder head of the engine. Due to length of the control valve unit, the bearing cap that has the control valve unit can cause the engine to be larger.

SUMMARY OF THE INVENTION

An aspect of the present invention involves the recognition of the need for an improved four-cycle engine layout that can make the engine smaller even though a control valve unit of the VVT system is provided as a part of the engine.

To address one or more of such needs, an aspect of the present invention involves an internal combustion engine that comprises an engine body having an outer surface that defines an outer area next thereto. An output shaft extends through the engine body. An air intake system is arranged to deliver air to at least one combustion chamber of the engine. The air intake system has an intake valve movable between a closed position at which the air is not allowed to move to the combustion chamber and an open position at which the air is allowed to move to the combustion chamber. An exhaust system is arranged to route exhaust gases in the combustion chamber to an external location of the engine. The exhaust system has an exhaust valve movable between a closed position at which the exhaust gases are not allowed to flow from the combustion chamber and an open position at which the exhaust gases are allowed to flow out the combustion chamber. At least one camshaft actuates the intake valve or the exhaust valve. The camshaft extends through the engine body and toward the outer area beyond the outer surface. A drive mechanism is arranged to drive the camshaft. At least a portion of the drive mechanism is disposed in the outer area. A hydraulically operated change mechanism is arranged to change an angular position of the camshaft relative to the output shaft. A control valve unit is configured to control the change mechanism. The control valve unit at least in part is disposed within the outer area.

In accordance with another aspect of the present invention, an internal combustion engine for an outboard motor comprises an engine body having at least an outer surface that defines an outer area next to thereto. An output shaft extends generally vertically through the engine body. An air intake system is arranged to deliver air to a combustion chamber of the engine. The air intake system has an intake valve movable between a closed position at which the air is not allowed to move to the combustion chamber and an open position at which the air is allowed to move to the combustion chamber. An exhaust system is arranged to route exhaust gases in the combustion chamber to an external location of the engine. The exhaust system has an exhaust valve movable between a closed position at which the exhaust gases are not allowed to flow from the combustion chamber location and an open position at which the exhaust gases are allowed to flow from the combustion chamber location. At least one camshaft actuates the intake valve or the exhaust valve. The camshaft extends generally vertically through the engine body and toward the outer area beyond the outer surface. A drive mechanism is arranged to drive the camshaft. At least a portion of the drive mechanism is disposed in the outer area. A hydraulically operated change mechanism is arranged to change an angular position of the camshaft relative to the output shaft. A control valve unit is configured to control the change mechanism. The control valve unit at least in part is disposed within the outer area.

BRIEF DESCRIPTION OF THE DRAWINGS

These and other features, aspects and advantages of the present invention are now described with reference to the drawings of a preferred embodiment, which embodiment is intended to illustrate and not to limit the present invention. The drawings comprise eleven figures in which.

DETAILED DESCRIPTION OF PREFERRED EMBODIMENT OF THE PRESENT INVENTION

Figure 1:
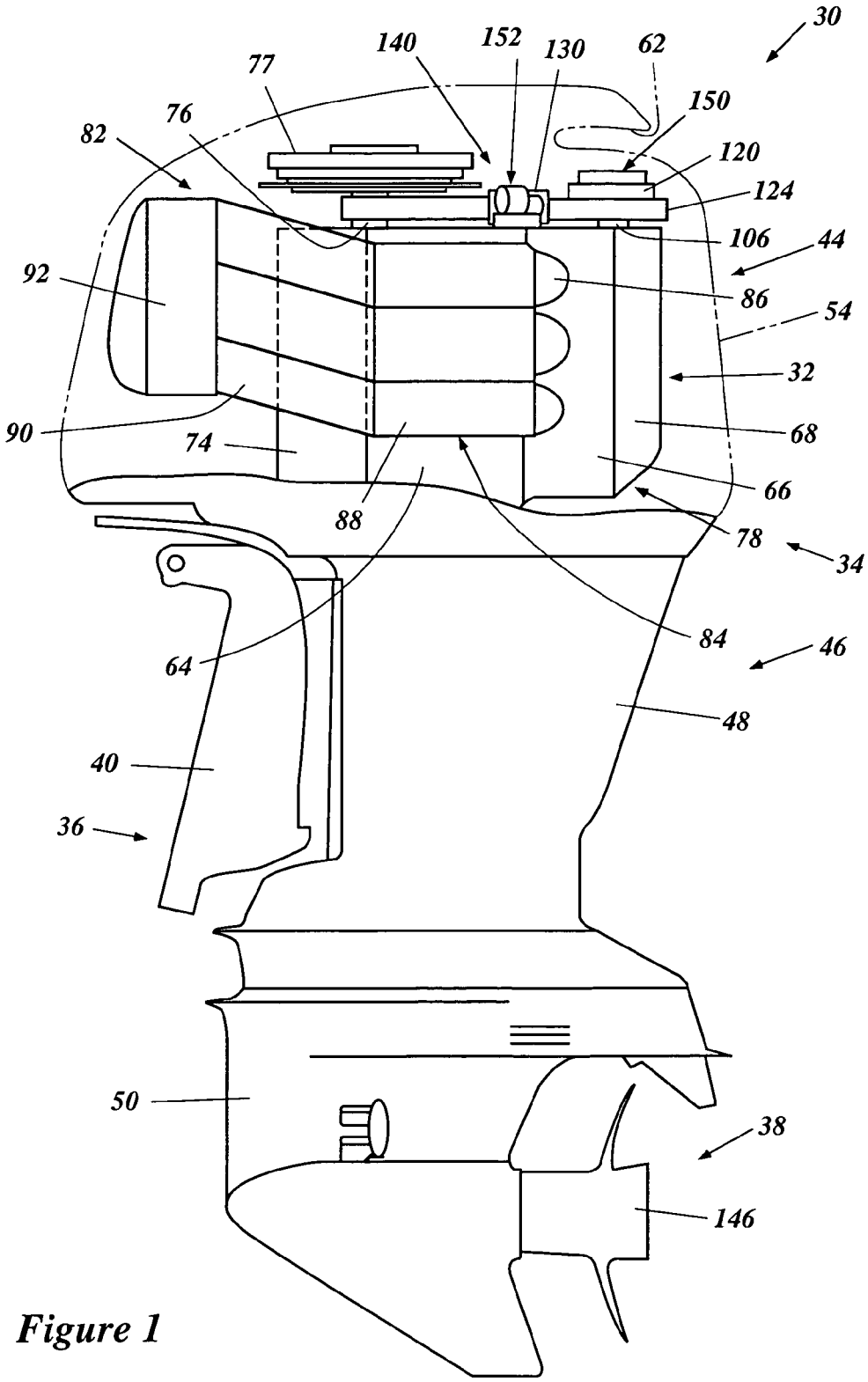
FIG. 1 illustrates a side elevational view of an outboard motor incorporating an engine configured in accordance with a preferred embodiment and advantages of the present invention, wherein a protective cowling assembly is partially sectioned to show a camshaft drive mechanism and a VVT system of the engine.
Figure 2:
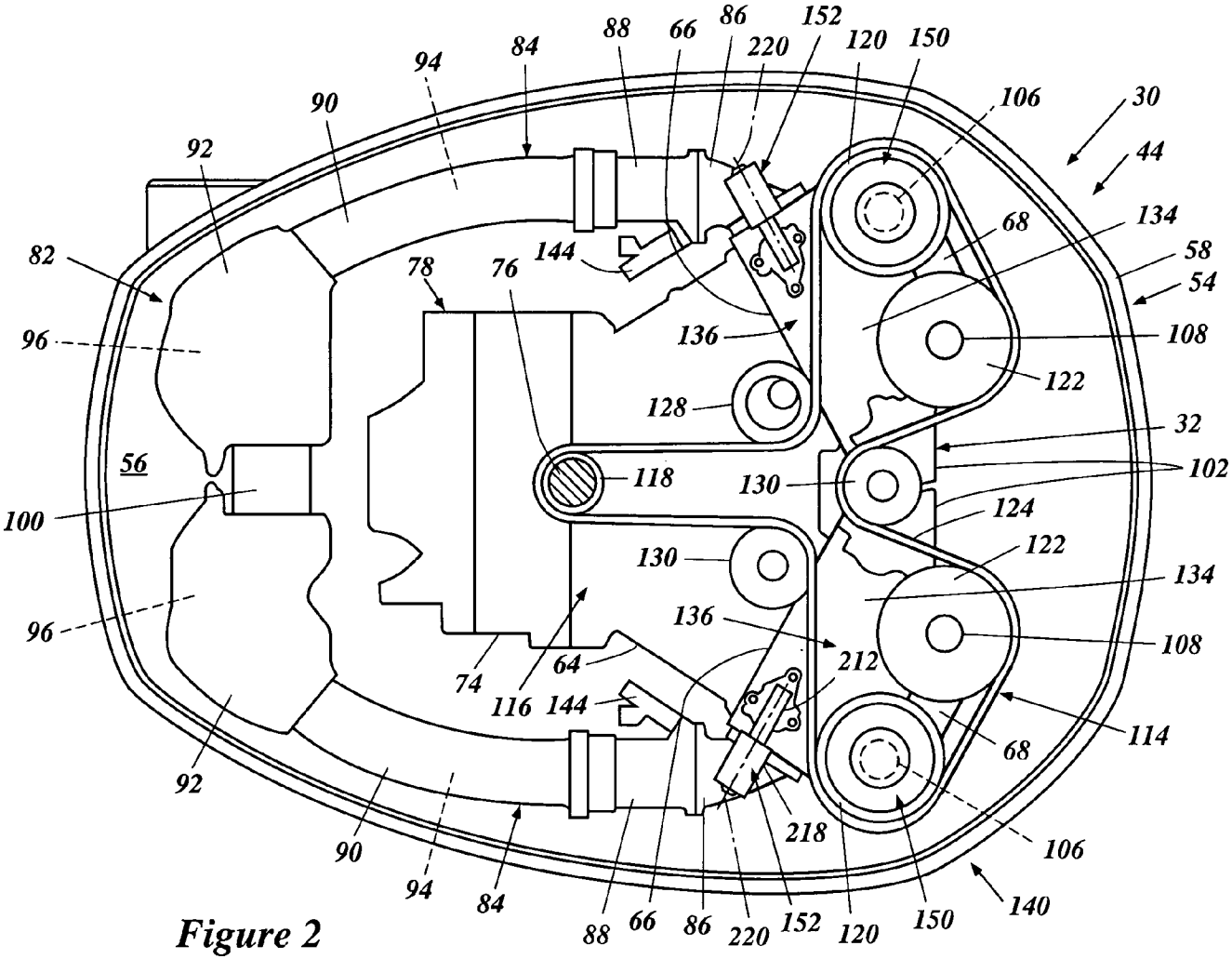
FIG. 2 illustrates a top plan view of the outboard motor of FIG. 1, wherein a top cowling member of the protective cowling assembly is detached to show the engine.
Figure 3:
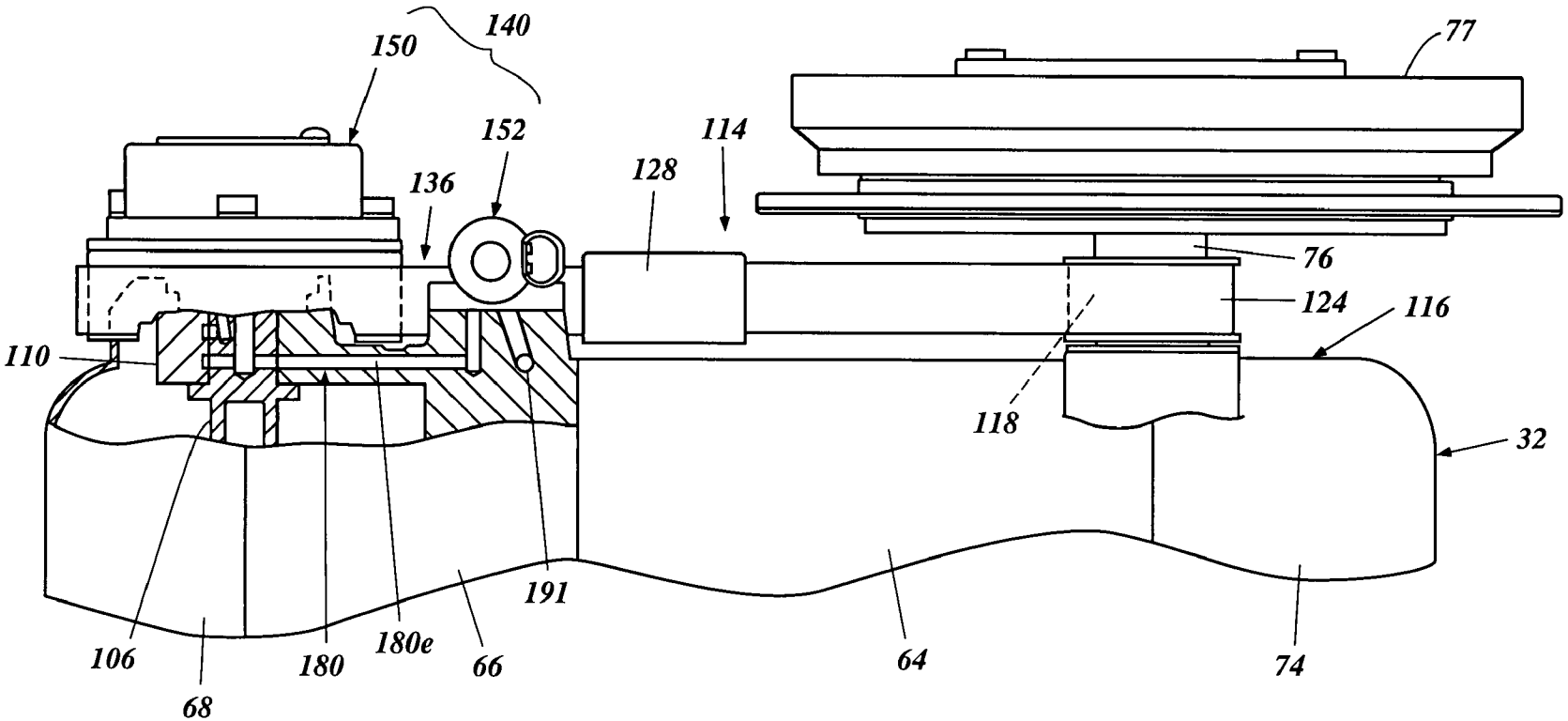
FIG. 3 illustrates a partial side elevational view of the engine, wherein a cylinder head member of the engine is partially sectioned.

With reference to FIGS. 1–3, an outboard motor 30 that incorporates an internal combustion engine 32 configured in accordance with the preferred embodiment of the present invention is described. The engine 32 has particular utility in the context of an outboard motor, and thus is described in this context. The engine 32, however, can be used with other types of marine drives (i.e., inboard motors, inboard/outboard motors, etc.) and also land vehicles and equipment. Furthermore, the engine 32 can be used as a stationary engine.

In the illustrated arrangement, the outboard motor 30 generally comprises a drive unit 34 and a bracket assembly 36. The bracket assembly 36 supports the drive unit 34 on a transom of an associated watercraft and places a marine propulsion device 38 in a submerged position with the watercraft resting relative to a surface of a body of water. The bracket assembly 36 preferably comprises a swivel bracket, a clamping bracket 40, a steering shaft and a pivot pin.

The steering shaft typically extends through the swivel bracket and is affixed to the drive unit 34. The steering shaft can be pivotally journaled for steering movement about a generally vertically extending steering axis defined within the swivel bracket. The clamping bracket 40 comprises a pair of bracket arms that preferably are laterally spaced apart from each other and that are attached to the watercraft transom.

The pivot pin completes a hinge coupling between the swivel bracket and the clamping bracket 40. The pivot pin preferably extends through the bracket arms so that the clamping bracket 40 supports the swivel bracket for pivotal movement about a generally horizontally extending tilt axis defined by the pivot pin. The drive unit 34 thus can be tilted or trimmed about the pivot pin.

As used through this description, the terms "forward," "forwardly" and "front" mean at or to the side where the bracket assembly 36 is located, unless indicated otherwise or otherwise readily apparent from the context used. The terms "rear," "reverse," "backwardly" and "rearwardly" mean at or to the opposite side of the front side, unless indicated otherwise or otherwise readily apparent from the context used.

A hydraulic tilt and trim adjustment system preferably is provided between the swivel bracket and the clamping bracket 40 for tilt movement (raising or lowering) of the swivel bracket and the drive unit 34 relative to the clamping bracket. Typically, the term "tilt movement," when used in a broad sense, comprises both a tilt movement and a trim adjustment movement.

The illustrated drive unit 34 comprises a power head 44 and a housing unit 46 which is formed principally by a driveshaft housing 48 and a lower unit 50. The power head 44 is disposed atop the housing unit 46 and includes the engine 32 that is enclosed within a protective cowling assembly 54, which preferably is made of plastic. In most arrangements, the protective cowling assembly 54 defines a generally closed cavity 56 (FIG. 2) in which the engine 32 is disposed. The engine 32, thus, is generally protected within the enclosure, which is defined by the cowling assembly 54, from environmental elements.

The protective cowling assembly 54 preferably comprises a top cowling member and a bottom-cowling member 58 (FIG. 2). The top cowling member preferably is detachably affixed to the bottom cowling member 58 by a coupling mechanism to facilitate access to the engine 32 and to other related components.

The top cowling member preferably has a rear intake opening 62 defined through an upper rear portion. A rear intake member with one or more air ducts can be unitarily formed with, or affixed to, the top cowling member. The rear intake member, together with the upper rear portion of the top cowling member, generally defines a rear air intake space. Ambient air is drawn into the closed cavity 56 via the rear intake opening 62 and the air ducts of the rear intake member. Typically, the top cowling member tapers in girth toward its top surface, which is general where of the air intake opening is located. The taper reduces the lateral dimension of the outboard motor, which lessens the air drag on the watercraft during movement.

The bottom cowling member 58 preferably has an opening through which an upper portion of an exhaust guide member extends. The exhaust guide member preferably is affixed atop the driveshaft housing 48. The bottom cowling member 58 and the exhaust guide member together generally form a tray. The engine 32 is placed onto this tray and can be connected to the exhaust guide member. The exhaust guide member also defines an exhaust discharge passage through which burnt charges (e.g., exhaust gases) from the engine 32 pass.

The engine 32 in the illustrated embodiment preferably operates on a four-cycle combustion principle. The presently preferred engine 32 is a double overhead camshaft (DOHC), six-cylinder engine and has a V-shaped cylinder block 64. The cylinder block 64 thus defines a pair of cylinder banks, which extend generally next to with each other. Each cylinder bank preferably has three cylinder bores such that the cylinder block 64 has six cylinder bores in total. The cylinder bores of each bank extend generally horizontally and are generally vertically spaced from one another. Each cylinder bore of one of the banks preferably is positioned slightly higher than the respective cylinder bore of the other bank. The illustrated engine 32 generally is symmetrical about a longitudinal center plane that extends generally vertically fore to aft. In some aspects of the present invention. This type of engine, however, merely exemplifies one type of engine structure with which at least some of the aspects and features of the present invention can be used. Engines having other numbers of cylinders and having other cylinder arrangements (in-line, opposing, etc.) also can be used with some aspects and features of the present invention.

As used in this description, the term "horizontally" means that the subject portions, members or components extend generally parallel to the water surface, i.e., generally normal to the direction of gravity, when the associated watercraft is substantially stationary with respect to the water surface and when the drive unit 34 is not tilted (i.e., is placed in the position shown in FIG. 1). The term "vertically" in turn means that the subject portions, members or components extend generally normal to those that extend horizontally.

A piston preferably reciprocates within each cylinder bore. Because the cylinder block 64 is principally defined by the two cylinder banks, each cylinder bank extends outward at an angle relative to the longitudinal center plane and each bank terminates at an end. A pair of cylinder head members 66 preferably is affixed to the respective ends of the cylinder banks to close those ends of the cylinder bores. Preferably, the cylinder head members 66, together with the associated pistons and cylinder bores, define six combustion chambers (not shown). Of course, the number of combustion chambers can vary, as indicated above. Each of the cylinder head member 66 preferably is covered with a cylinder head cover member 68.

A crankcase assembly 74 preferably is coupled with the cylinder block 64. The crankcase assembly 74 closes the other end of the cylinder bores and, together with the cylinder block 64, define a crankcase chamber. A crankshaft or output shaft 76 preferably extends generally vertically through the crankcase chamber and is journaled for rotation about a rotational axis by one or more bearing blocks. The rotational axis of the crankshaft 76 preferably lies on the longitudinal center plane. Connecting rods couple the crankshaft 76 with the respective pistons in any suitable manner. Thus, the reciprocal movement of the pistons rotates the crankshaft 76. A flywheel assembly 77 preferably is disposed atop the crankshaft 76.

In the illustrated embodiment, the crankcase assembly 74 is forwardly disposed, with the cylinder block 64, the cylinder head members 66 and the cylinder head cover members 68 being disposed rearward from the crankcase member 74 one after another. In the illustrated arrangement, the cylinder block 64, the cylinder head members 66, the cylinder head cover members 68 and the crankcase assembly 74 together define an engine body 78. Preferably, at least these major engine portions 64, 66, 68, 74 are made of aluminum alloy. In some arrangements, the cylinder head cover members 68 can be unitarily formed with the respective cylinder head members 66.

The engine 32 is provided with an air intake system 82. The air intake system 82 draws air from within the closed cavity 56 and delivers the air to the combustion chambers. The air intake system 82 preferably comprises a pair of intake manifolds 84. Each intake manifold 84 is allotted to the respective cylinder bank. Each intake manifold 84 in the illustrated arrangement comprises one base block 86, three throttle bodies 88, three runners 90 and one plenum member 92.

Each base block 86 is affixed to the respective cylinder head member 66 and all the members 86, 88, 90, 92 lie along a respective side surface of the engine body 78. The runners 90 of each intake manifold 84 extend generally in parallel to each other and are vertically spaced apart from one another. Each throttle body 88 is attached to the bore block 86, and each valve extends between the respective throttle body 88 and the plenum member 92, which lies near a front side of the engine body 78 in the illustrated embodiment.

Each set of the base block 86, the throttle bodies 88 and runners 90 together define upstream portions of three intake passages 94 which correspond to the respective combustion chambers of each cylinder bank. Each plenum member 92 defines a plenum chamber 96 therein and the intake passages 94 are connected to the plenum chamber 96. The illustrated plenum members 92 are connected to each other through a balance pipe 100. In one variation, a larger single plenum member can replace the plenum members 92.

The most-downstream portions of the intake passages 94 are defined within the cylinder head members 66 as inner intake passages. The inner intake passages communicate with the combustion chambers through intake ports, which are formed at inner surfaces of the cylinder head members 66. Each combustion chamber has one or more intake ports. In this arrangement, for example, two intake ports are provided for each combustion chamber.

Intake valves are disposed at each cylinder head member 66 to move between an open position and a closed position. As such, the valves act to open and close the intake ports to control the flow of air into the combustion chamber. Biasing members, such as springs, urge the intake valves toward the respective closed positions by acting between a mounting boss formed on each cylinder head member 66 and a corresponding retainer that is affixed to each valve. When each intake valve is in the open position, the inner intake passage that is associated with the intake port communicates with the associated combustion chamber and air is allowed to move to the combustion chamber. On the other hand, when each intake valve is in the closed position, the inner intake passage does not communicate with the associated combustion chamber and air is not allowed to move into the combustion chamber.

Each throttle body 88 preferably has a butterfly type throttle valve journaled within the throttle body 88 for pivotal movement. The throttle valves are coupled with a control linkage. The control linkage can be connected to an operational member such as, for example, a remote control lever or a throttle lever. The operational member preferably is provided on the watercraft or otherwise proximate the operator in the watercraft. The operator can control an amount of opening (e.g., angular position) of the throttle valves through the control linkage. The throttle valves regulate an amount of air that flow through the intake passages 94 to the combustion chambers in accordance with the opening degree of the throttle valves. Normally, the greater the opening of the throttle valves the higher the rate of airflow and the higher the engine speed.

The respective plenum chambers 96 preferably define air inlets through which air is drawn into the plenum chambers 96. The plenum chambers 96 smooth airflow delivered to each intake passage and also act as silencers to reduce intake noise.

As thus constructed, the air drawn into the plenum chambers 96 is smoothed in the plenum chambers 96 and flows through the respective intake passages 94 toward the respective combustion chambers. The throttle valves regulates the airflow before the air enters the combustion chambers.

The engine 32 preferably is provided with an exhaust system that routes burnt charges, i.e., exhaust gases, outside the outboard motor 30. Each cylinder head member 66 preferably defines a set of inner exhaust passages that communicate with the combustion chambers through one or more exhaust ports. In this arrangement, for example, two exhaust ports are provided for each combustion chamber. The exhaust ports and the inner exhaust passages preferably are defined on the other side of the respective cylinder head members 66 relative to the intake ports and the inner intake passages. The exhaust ports can be selectively opened and closed by exhaust valves. The construction of each exhaust valve and an arrangement of the exhaust valves can be substantially the same as the intake valve and the arrangement thereof.

The sides of the respective banks where the inner exhaust passages are defined together form a valley therebetween. A portion of the cylinder block 64 located in between the bank sides (i.e., within the valley) preferably defines a pair of exhaust manifolds 102 that extend generally vertically. The exhaust manifolds 102 communicate with the combustion chambers through the inner exhaust passages and the exhaust ports to collect exhaust gases therefrom. The exhaust manifolds are coupled with the exhaust discharge passage of the exhaust guide member. The combustion chambers communicate with the exhaust discharge passage through the exhaust manifolds 102 when the exhaust ports are opened.

A valve cam mechanism preferably is provided for actuating the intake and exhaust valves in each cylinder bank. The valve cam mechanism in the illustrated embodiment includes an intake camshaft 106 and an exhaust camshaft 108 for each cylinder bank. The intake and exhaust camshafts 106, 108 of each bank preferably extend generally vertically and are journaled for rotation generally between the cylinder head members 66 and the cylinder head cover members 68. In the illustrated arrangement, each camshaft 106, 108 is journaled between the cylinder head member 66 and one or more bearing caps 110 (FIG. 3) inside of the cylinder head cover member 68. The intake and exhaust camshafts 106, 108 have cam lobes to push valve lifters that cooperate with the respective ends of the intake and exhaust valves in any suitable manner. One cam lobe preferably is allotted to each valve. The cam lobes repeatedly push the valve lifters in a timed manner, which is in proportion to the engine speed. The movement of the lifters generally is timed by rotation of the camshafts 106, 108 to appropriately actuate the intake and exhaust valves.

A camshaft drive mechanism 114 preferably is provided for driving the intake and exhaust camshafts 106, 108. The camshaft drive mechanism 114 is, in other words, a transmitting device that transmits driving force to the camshafts 106, 108 from the crankshaft 76. The camshaft drive mechanism 114 in the illustrated arrangement is formed above a top surface 116 of the engine body 78. In other words, the drive mechanism 114 is disposed above the engine body 78; however, it can be located at other locations (e.g., with the engine body or below the engine body). It also can be divided so as to have a plurality of transmitter (e.g., one belt drives the exhaust camshaft and then two additional belts drive each intake camshaft off the corresponding exhaust camshaft).

In the illustrated embodiment, the drive mechanism 114 comprises a drive pulley 118 disposed on a portion of the crankshaft 76 below the flywheel assembly 77, intake driven pulleys 120 disposed atop the respective intake camshafts 106 and exhaust driven pulleys 122 disposed atop the respective exhaust camshafts 108, and a flexible transmitter such as, for example, a timing belt 124 wound around the drive pulley 18 and the respective driven pulleys 120, 122. The drive and driven pulleys 120, 122 are located generally on the same level. The timing belt 124 is endless or is formed as a loop to surround the crankshaft 76 and the camshafts 106, 108. In one variation, a set of sprockets and a timing chain can replace the set of the pulleys 118, 120, 122 and the timing belt 124.

The illustrated crankshaft 76 thus drives the respective camshafts 106, 108 through the timing belt 124 in the timed relationship. The diameter of each driven pulley 106, 108 is twice as larger as the diameter of the drive pulley 118 such that the intake and exhaust camshafts 106, 108 rotate at half of the crankshaft speed. A belt tensioner 128 provided at a loose side of the timing belt 124 advantageously maintains the belt 124 under a desired degree of tension. The illustrated belt tensioner 128 generally has a cylindrical shape. Also, idle pulleys 130 are provided to maintain sufficient contact area between the pulleys 118, 120, 122 and the timing belt 124 to drive the camshafts properly.

The camshaft drive mechanism 114 can have any configurations or any arrangements other than that described above. For example, the crankshaft 76 can drive exhaust camshafts 108 first and then each exhaust camshaft 108 drives the respective intake camshaft 106 associated with the exhaust camshaft 108 in the same cylinder bank. In another alternative, the crankshaft 76 drives an intermediate shaft and then the intermediate shaft drives the intake and exhaust camshafts 106, 108.

In the illustrated arrangement, each cylinder head member 66, as a portion of the engine body 78, has a top surface 134 above which top area or outer area 136 (FIG. 3) lies. As shown in FIGS. 2 and 3, at least a portion of the driven pulleys 120, 122 and a portion of the timing belt 124 are disposed in the top area 136.

The illustrated engine 32 also is provided with a variable valve timing (VVT) system 140 associated with the intake camshafts 106. The VVT system 140 can change valve timings of the intake valves in response to the engine speeds. Preferably, the illustrated VVT system 140 changes an angular position of the respective intake camshaft 106 by controlling fluid flow in the system 140. Accordingly, the intake camshafts 106 can vary valve timing between a fully delayed timing and a fully advanced timing. The engine 32 thus can obtain high charging efficiency in a relatively high engine speed range and low fuel consumption and superior exhaust characteristics in a relatively low engine speed range. The VVT system 140 will be described in greater details below.

The engine 32 preferably comprises either a direct or indirect fuel injection (e.g., port injection) system. The illustrated engine 32 employs an indirect fuel injection system. The fuel injection system preferably comprises six fuel injectors 144 with one fuel injector 144 allotted to each combustion chamber, although a greater or fewer number of fuel injectors can be used (e.g. a primary and a secondary fuel injector for each cylinder). Each fuel injector 144 preferably has an injection nozzle directed to the associated intake passage 94 in the base block 86 of the respective intake manifold 84. Preferably, multiple fuel pumps develop an appropriate fuel pressure and a pressure regulator strictly manages the fuel pressure. The fuel injectors 144 spray fuel into the intake passages 94 under control of an electronic control unit (ECU) (not shown). The ECU controls both the initiation timing and the duration of the fuel injection cycle of the fuel injectors 144 so that each nozzle spray a desired amount of fuel during each respective combustion cycle.

Other charge forming devices can be used instead of a fuel injection system. For example, one or more carburetors can be applied to supply the fuel to the combustion chambers.

The engine 32 preferably comprises an ignition system. The combustion chambers are provided with spark plugs that preferably are affixed to plug holes formed at each cylinder head member 66 and between the intake and exhaust valves. Each spark plug has electrodes that are exposed in the associated combustion chamber. The electrodes are spaced apart from each other by a small gap. Each spark plug generates a spark between the electrodes to ignite an air/fuel charge in the combustion chamber at a proper ignition timing also under control of the ECU.

Generally, during an intake stroke, air is drawn into the combustion chambers through the air intake passages and fuel is mixed with the air by the fuel injectors or carburetors. The mixed air/fuel charge is introduced to the combustion chambers. The mixture is then compressed during a compression stroke. Preferably just prior to a power stroke, the respective spark plugs ignite the compressed air/fuel charge in the respective combustion chambers. The air/fuel charge thus rapidly burns during the power stroke to move the pistons. The burnt charge, i.e., exhaust gases, then is discharged from the combustion chambers during an exhaust stroke.

The engine 32 may comprise any other systems, mechanisms, devices, accessories and components other than those described above such as, for example, a cooling system and a lubrication system. In the illustrated embodiment, the VVT system 140 uses part of lubricant oil of the lubrication system as a working fluid.

With reference back to FIG. 1, the driveshaft housing 48 depends from the power head 44 and supports a driveshaft, which is coupled with the crankshaft 76 and which extends generally vertically through the driveshaft housing 48. The driveshaft is journaled for rotation and is driven by the crankshaft 76.

The driveshaft housing 48 preferably defines an internal section of the exhaust system that leads the majority of exhaust gases to the lower unit 50. The internal section includes an idle discharge portion that extends from a main portion of the internal section to discharge idle exhaust gases directly to the atmosphere through a discharge port that is formed on a rear surface of the driveshaft housing 48.

The lower unit 50 depends from the driveshaft housing 48 and supports a propulsion shaft that is driven by the driveshaft. The propulsion shaft extends generally horizontally through the lower unit 50 and is journaled for rotation. The marine propulsion device 38 is formed on the propulsion shaft. In the illustrated arrangement, the propulsion device 38 is a propeller 146 that is affixed to an outer end of the propulsion shaft. The propulsion device 38, however, can take the form of a dual counter-rotating system, a hydrodynamic jet, or any of a number of other suitable propulsion devices.

A transmission preferably is provided between the driveshaft and the propulsion shaft, which lie generally normal to each other (i.e., at a 90° shaft angle) to couple together the two shafts by bevel gears, for example. The outboard motor 30 has a clutch mechanism that allows the transmission to change the rotational direction of the propeller 146 among forward, neutral or reverse modes.

The lower unit 50 also defines an internal section of the exhaust system that is connected with the internal exhaust section of the driveshaft housing 48. At engine speeds above idle, the exhaust gases generally are discharged to the body of water surrounding the outboard motor 30 through the internal sections and then a discharge section defined within the hub of the propeller 146, for example.

With continued reference to FIGS. 1–3 and with additional reference to FIGS. 4–11, the VVT system 140 is described below.

The VVT system 140 preferably is configured to adjust the angular position of each intake camshaft 106 relative to the intake driven pulley 120 between two limits, i.e., a fully delayed angular position and a fully advanced angular position. At the fully delayed position, the intake camshaft 106 opens and closes the intake valves at a most delayed timing. In contrast, at the fully advanced position, the intake camshaft 106 opens and closes the intake valves at a most advanced timing.

The VVT system 140 preferably comprises a pair of hydraulically operated change mechanisms 150 and a pair of control valve units 152. At least one change mechanism 150 and one control valve unit 152 are hydraulically coupled with each other. Each change mechanism 150 preferably sets the intake camshaft 106 to an angular position in response to a volume of working fluid that is allotted to two spaces of the change mechanism 150. Each control valve unit 152 preferably regulates a rate or amount of the fluid directed to the respective change mechanism 150 under control of the ECU. The ECU preferably determines the rate of the fluid in accordance with an engine speed of the engine 32. As noted above, the working fluid in the illustrated embodiment is a portion of the lubricant, which is primarily used for the lubrication system. Of course, the VVT system 140 can use an exclusive or particular oil or something equivalent as the working fluid.

Figure 4:
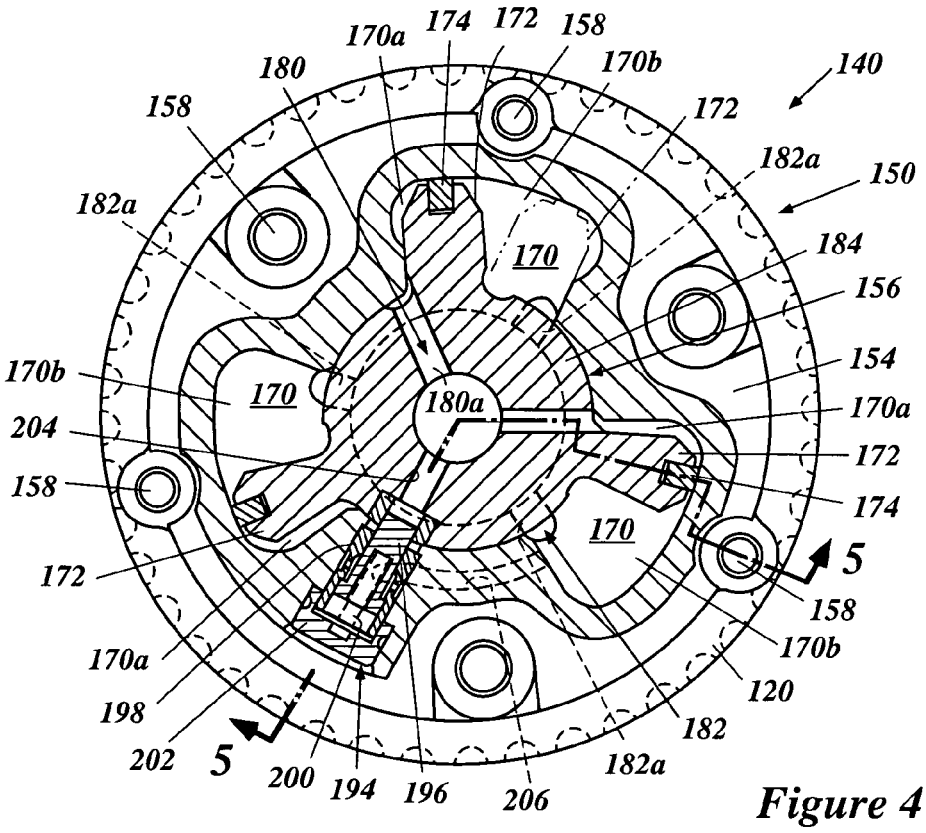
FIG. 4 illustrates a cross-sectional plan view of a change mechanism of the VVT system taken along the lines 4—4 of FIG. 5.
Figure 5:
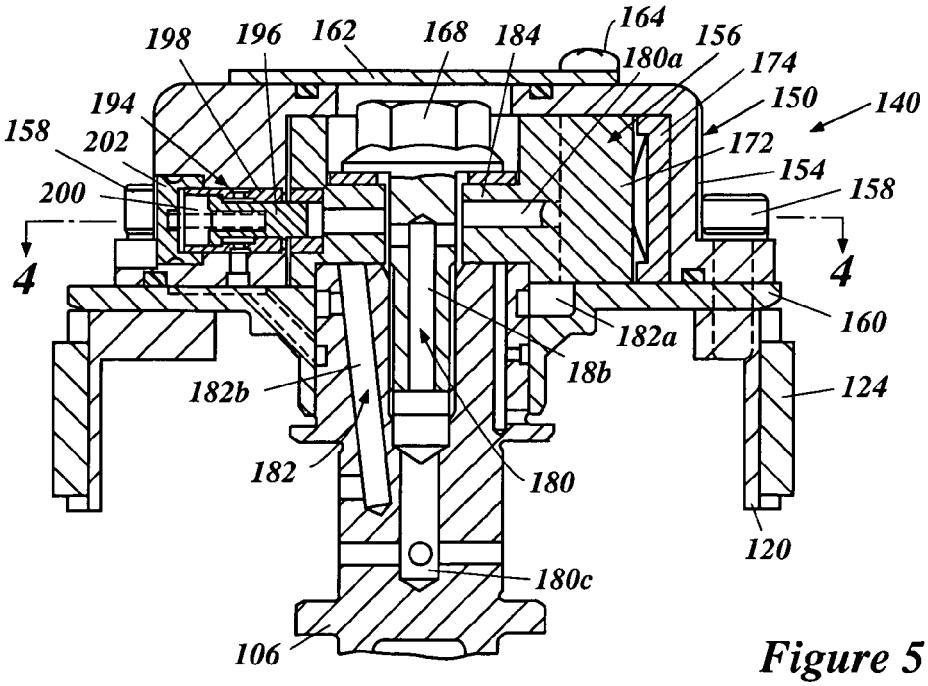
FIG. 5 illustrates a cross-sectional side view of change mechanism taken along the lines 5—5 of FIG. 4.

With reference to FIGS. 4 and 5, each change mechanism 150 preferably includes an outer housing 154 and an inner rotor 156. The outer housing 154 preferably is affixed to the intake driven pulley 120 by six bolts 158 via a circular intermediate member 160. The intermediate member 160 also is a bottom member that forms an inner cavity together with the housing 154. A top plate 162 is affixed to a top portion of the housing 154 by bolts 164 to close the inner cavity.

The inner rotor 156 preferably is affixed atop the intake camshaft 106 by a bolt 168. Because a top portion of the intake camshaft 106 slightly extends into the inner cavity through the intermediate member 160, the inner rotor 156 is wholly disposed in the inner cavity. The rotor 156 divides the inner cavity to define three fluid chambers 170 together with the outer housing 154 and the intermediate member 160. The inner rotor 156 also has three vanes 172 that extend radially and are that spaced apart from each other at an angle of about 120 degrees apart. Each vane 172 is movable (rotatable) within each fluid chamber 170. The number of the fluid chambers 170 and the number of the vanes 172 of course can vary in other embodiments.

Each vane 172, together with a seal member 174, further divides each fluid chamber 170 into an advance side space **170*a* and a delay side space 170*b*. Each seal member 174 is carried by the respective vane 172 and abuts an inner surface of the housing 154 and thereby substantially seal the advance and delay side spaces 170*a*, 170*b* from each other. The advance side spaces 170*a* are spaces in which the working fluid is supplied to drive the intake camshaft 106 toward a desired advanced position. The delay side spaces 170*b* are spaces in which the working fluid is supplied to drive the intake camshaft 106 toward a desired delayed position. Each volume of the respective advance and delay side spaces 170*a*, 170*b* varies in response to an amount of the working fluid that is supplied into the respective spaces 170*a*, 170*b*. Thus, the respective intake camshaft 106 can change its angular position in accordance with the volume of the respective advance and delay side spaces 170*a*, 170*b* between the fully delayed position and the fully advanced position. FIG. 4 illustrates that the inner rotor 156 is placed at the fully delayed position. FIG. 4 also illustrates one of the vanes 172 of the rotor 156** placed at the fully advanced position by the phantom line.

Both sets of the advance and delay side spaces **170*a*, 170*b* preferably are connected to inner spaces of the control valve unit 152 (FIGS. 1–3 and 9–11), which is disposed on the respective cylinder head member 66, through an advance side fluid passage 180 and a delay side fluid passage 182. The advance and delay side passages 180, 182 preferably are formed in the respective intake camshaft 106 and the respective cylinder head member 66. The advance side passage 180 conveys the working fluid to the advance side spaces 170***a* from the control valve unit 152 when the control valve unit 152 takes an advance mode, while the delay side passage 182 conveys the working fluid to the delay side spaces 170*b* from the control valve unit 152 when the control valve unit 152 takes a delay mode.

With reference to FIGS. 3–8, the respective advance side passage 180 in the illustrated embodiment comprises a first section 180*a*, a second section 180*b*, a third section 180*c*, a fourth section 180*d* and a fifth section 180*e*, which are placed one after another in this order. The working fluid flows from the fifth section 180*e* to the first section 180*a* via the intermediate sections 180*b*, 180*c*, 180*d*.

With reference to FIGS. 4 and 5, the first section 180*a* is coupled with the respective advance side spaces 170*a*. In the illustrated embodiment, the first section 180*a* preferably extends generally horizontally and radially through the respective vanes 172 between a boss 184 of the rotor 156 and the respective advance side spaces 170*a*. Because the bolt 168 extends vertically through the boss 184 of the rotor 156, a center portion of the first section 180*a* is defined around the bolt 168 in this arrangement.

With reference to FIG. 5, the second section 180*b* is coupled with the first section 180*a* and preferably extends generally vertically and downward through the bolt 168 to a bottom end of the bolt 168.

With continued reference to FIG. 5, the third section 180*c* is coupled with the second section 180*b*. The third section 180*c* preferably extends generally vertically downward through the respective intake camshaft 106 and then extends generally horizontally and radially within the intake camshaft 106. Each path of the third section 180*c* open at an outer surface of the intake camshaft 106.

Figure 7:
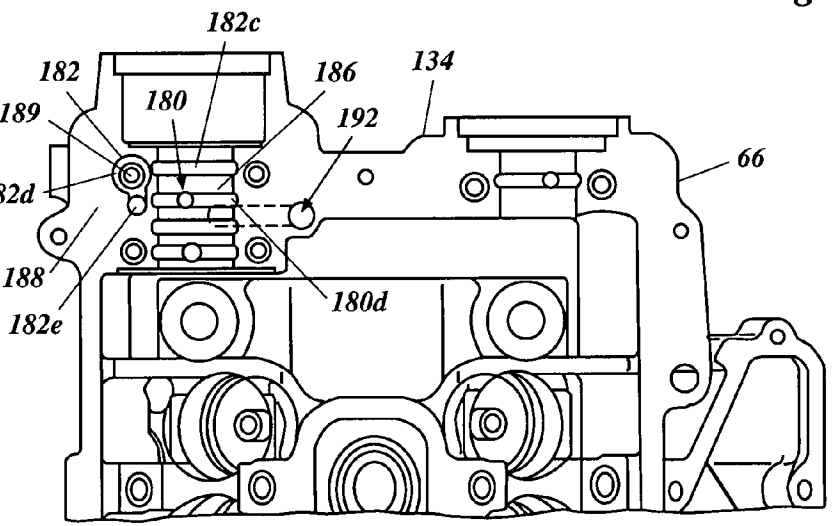
FIG. 7 illustrates an enlarged side elevational view of the cylinder head member of FIG. 6 to show a vertical surface that faces a cylinder head cover member of the engine in the illustrated embodiment.
Figure 8:
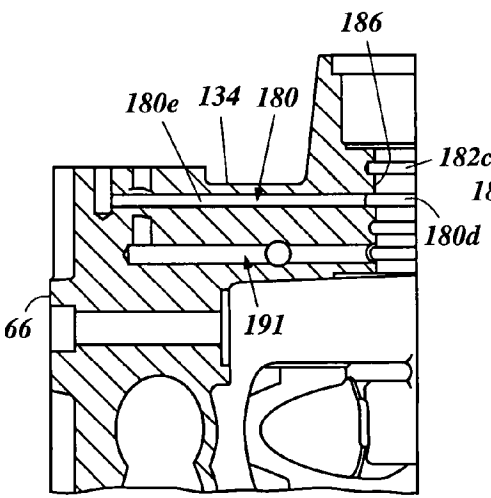
FIG. 8 illustrates a cross-sectional side view of the cylinder head member of FIG. 6 taken along a plane including an axis of an advance side fluid passage.

With reference to FIGS. 7 and 8, the fourth section 180*d* is coupled with the third section 180*c*. At least a semicircular recess defined at a journal portion 186 of the respective cylinder head member 66 preferably forms the fourth section 180*d*. Another semicircular recess can be defined at a journal portion of the respective cylinder cover member 68 that meets the semicircular recess of the cylinder head member 66. The semicircular recess of the cylinder cover member 68 can form a further portion of the fourth section 180*d*. The respective journal portions 186 of the cylinder head and cylinder head cover members 66, 68 journal the intake camshaft 106 for rotation in the illustrated embodiment.

With reference to FIGS. 3 and 6–8, the fifth section 180*e* is coupled with the fourth section 180*d*. The fifth section 180*e* preferably is an internal passage that extends generally horizontally and forwardly within the respective cylinder head member 66 and then extends generally vertically and upward toward a location below the control valve unit 152.

On the other hand, with reference to FIGS. 4–8, the respective delay side passage 182 in the illustrated embodiment, comprises a first section 182*a*, a second section 182*b*, a third section 182*c*, a fourth section 182*d* and a fifth section 182*e*, which are placed one after another in this order. The working fluid flows from the fifth section 182*c* to the first section 182*a* via the intermediate sections 182*b*, 182*c*, 182*d*.

With reference to FIGS. 4 and 5, the first section 182*a* is coupled with the respective delay side spaces 170*b*. The first section 182*a* preferably extends generally horizontally from the respective bottom portions of the delay side spaces 170*b* through the intermediate member 160 and then contiguously extends through the top end of the respective intake camshaft 106.

With reference to FIG. 5, the second section 182*b* is coupled with the first section 182*a* and preferably extends generally vertically and downward through the intake camshaft 106. The illustrated second section 182*b* slightly inclines inward toward a center of the intake camshaft 106. The second section 182*b* then extends generally horizontally and opens at an outer surface of the intake camshaft 106 in the illustrated embodiment.

With reference to FIGS. 7 and 8, the third section 182*c* is coupled with the second section 182*b*. At least a semicircular recess defined at the journal portion 186 of the respective cylinder head member 66 preferably forms the third section 182*c*. Another semicircular recess can be defined at the journal portion of the respective cylinder cover member 68 that meets the semicircular recess of the cylinder head member 66. The semicircular recess of the cylinder cover member 68 can form a further portion of the third section 182*c*.

With reference to FIG. 7, the fourth section 182*d* is coupled with the third section 182*c*. The fourth section 182*d* preferably is a circular recess defined at an outer surface 188 of the cylinder head member 106 onto which one of the bearing caps 110 (FIG. 3) is affixed. The illustrated circular recess, i.e., the fourth section 182*b*, is formed around one of holes where bolts are inserted to fix the bearing cap 110 to the cylinder head member 106. The particular hole is indicated by the reference numeral 189 of FIG. 7.

Figure 6:
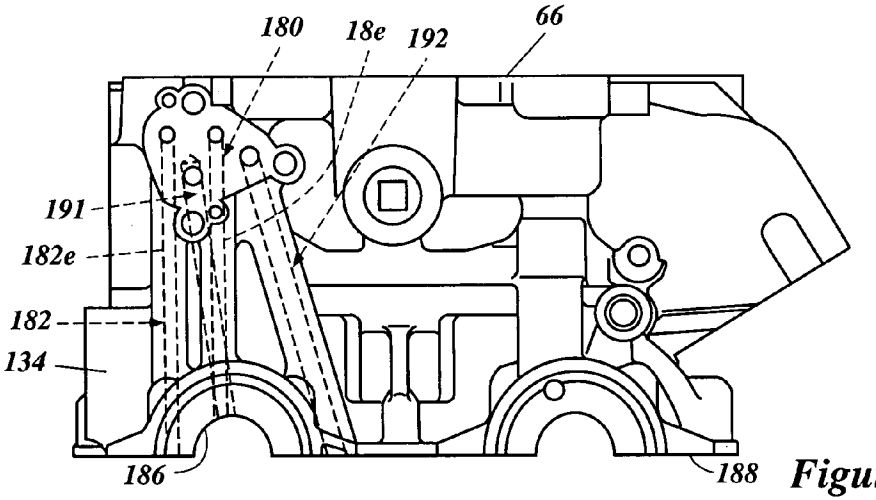
FIG. 6 illustrates a top plan view of the cylinder head member of the engine.

With reference to FIGS. 6 and 7, the fifth section 182*e* is coupled with the fourth section 182*d*. The fifth section 182*e* preferably is an internal passage that extends generally horizontally and forwardly in parallel to the fifth section 180*e* of the advance side passage 180 within the respective cylinder head member 66. The fifth section 182*e* then extends generally vertically and upward toward the location below the control valve unit 152.

With reference to FIGS. 3, 6 and 7, a fluid supply passage 191 and a fluid return passage 192 preferably are internally formed within the cylinder head member 66. The fluid supply passage 191 connects the control valve unit 152 with a lubricant reservoir through a lubricant pump. The working fluid is supplied to the control valve unit 152 through the fluid supply passage 191 when the lubricant pump operates. The fluid return passage 192 also connects the control valve unit 152 with the fluid reservoir and the working fluid returns to the fluid reservoir from the control valve unit 152 at least through the fluid return passage 192; the working fluid can be delivered to other engine locations before moving toward the fluid reservoir (e.g., in oil pan).

With reference to FIGS. 4 and 5, the respective change mechanism 150 of the VVT system 140 preferably has a lock unit 194 that generally fixes the inner rotor 156 at an initial position while the pressure of the working fluid is low, for example, when the engine 32 is at a standstill. In this embodiment, the initial position is the position corresponding to the fully delayed position of the respective intake camshaft 106.

The respective intake driven pulley 120 supports the lock unit 194 in an opening of the outer housing 154. The lock unit 194 preferably comprises a lock pin 196, a guide member 198, a bias spring 200 and a closure member 202. The guide member 198 is inserted into the opening of the outer housing 154. The lock pin 196 is slideably disposed within the guide member 198. The guide member 198 guides the slide movement of the lock pin 196. A circular recess is formed in an inner surface of the guide member 198 to define a space between the inner surface and an outer surface of the lock pin 196. The lock pin 196 has a recess defined along an axis of the lock pin 196 and extending toward an outer surface of the driven pulley 120. The closure member 202 sealingly closes an outer side of the opening. The bias spring 200 is positioned between a bottom of the recess of the lock pin 196 and an inner surface of the closure member 202. The bias spring 200 thus urges the lock pin 196 toward the rotor 156.

One of the respective paths of the first section 180*a* of the advance side passage 180 defines a first pressure exerting pathway 204. The first pressure exerting pathway 204 is positioned at a location where the lock pin 196 is positioned when the rotor 156 is placed in the fully delayed position. The lock pin 196 thus is urged into the first pressure exerting pathway 204 by the bias spring 200. Accordingly, the rotor 156 is locked in the fully delayed position unless any force is applied to retract the lock pin 196 into the guide member 198 against the bias force of the bias spring 200.

The force that retracts the lock pin 196 is provided by the pressure of the working fluid. The force preferably is exerted onto the lock pin 196 through the first pressure exerting pathway 204 when the fluid pressure is generated in the advance side passage 180 or a second pressure exerting pathway 206 when the fluid pressure is generated in the delay side passage 182. The second pressure exerting pathway 206 generally is formed within the outer housing 154 and extends between one of the delay side spaces 170*b* and the circular recess formed in the inner surface of the guide member 198. The lock pin 196 thus is retracted into the guide member 198 whichever the fluid pressure generated in the advance or delay side passage 180, 182 is exerted onto the lock pin 196. The path is a portion of the first pressure exerting pathway 204 is connected to the associated advance side space 170*a* when the lock pin 196 is fully retracted. Accordingly, the rotor 156 is released for rotation whenever the intake camshaft 106 is moved to any advanced position or delayed position from its initial position (e.g., fully delayed position). The rotor 156 automatically returns back to the initial position on its own because the intake camshaft 106 is normally forced toward the fully delayed position by the camshaft drive torque unless the VVT system 140 is activated.

With reference to FIGS. 1–3 and 9–11, the respective control valve unit 152 preferably is affixed onto the top surface 134 of the respective cylinder head member 66 by a bracket portion 210. In the illustrated arrangement, as shown in FIG. 1, the respective control valve unit 152 is positioned next to the timing belt 124 and preferably out of the loop that is made by the timing belt 124. Also, as shown in FIG. 3, the respective control valve unit 152 is positioned generally at the same elevational level as the timing belt 124.

Figure 9:
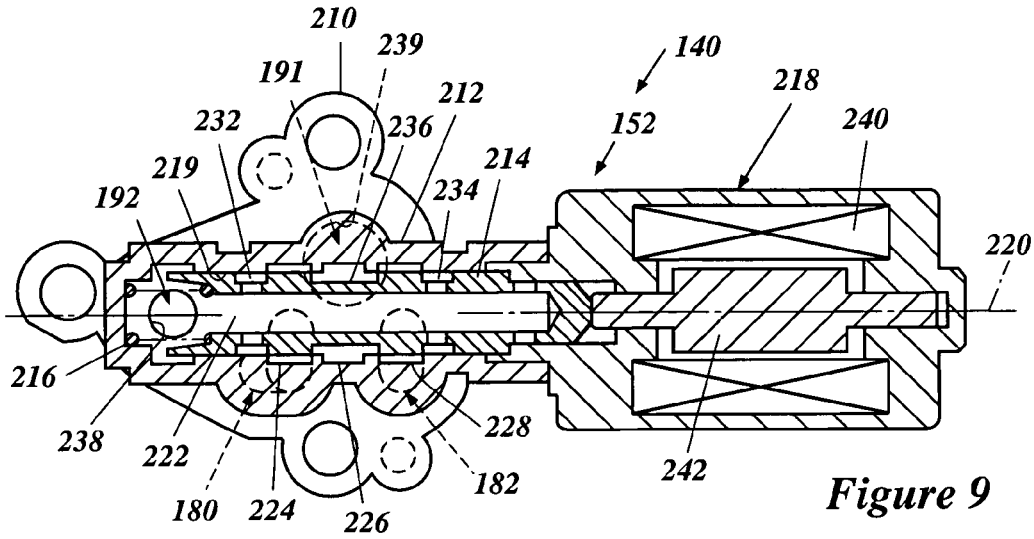
FIG. 9 illustrates a schematic representation of a control valve unit of the VVT system, wherein a spool of the control valve unit is set in a neutral mode.
Figure 10:
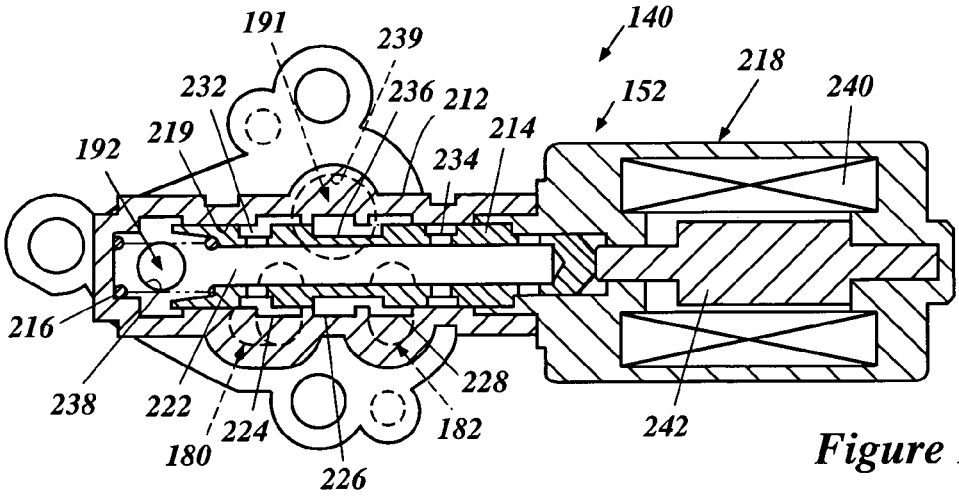
FIG. 10 illustrates another schematic representation of the control valve unit, wherein the spool is set in a delay mode.
Figure 11:
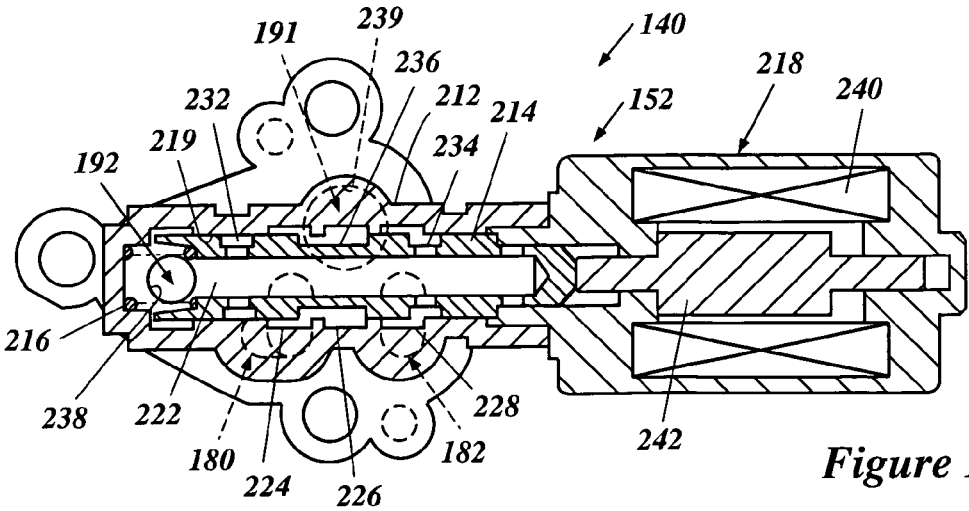
FIG. 11 illustrates a further schematic representation of the control valve unit, wherein the spool is set in an advance mode.

With reference to FIGS. 9–11, the control valve unit 152 preferably comprises a housing 212, a spool 214, a bias spring 216 and a solenoid assembly 218. The bracket portion 210 extends from the housing 212. The housing 212 generally forms a cavity 219, one end of the cavity 219 being closed. The housing 212 houses the spool 214 within the cavity 219. The solenoid assembly 218 is affixed to an open end of the housing 212 that is positioned opposite to the closed end.

The housing 212 and the solenoid assembly 218 preferably have a common longitudinal axis 220. The respective control valve unit 152 is positioned above the cylinder head member 106 such that the longitudinal axis 220 extends generally parallel to the top surface 134 of the respective cylinder head member 106.

In the illustrated arrangement, the respective housing 212 generally is positioned above the top surface 134 of the cylinder head member 66. In other words, each housing 212 lies within the top area 136 of each cylinder head member 66. The illustrated solenoid assembly 218, however, overhangs generally over the base block 86 of the respective intake manifold 84. That is, the respective solenoid assembly 218 extends beyond the top area 136 and overlaps with the respective base block 86 in the view generally normal to the top surface 134 of the cylinder member 66 (i.e., in the top plan view).

Each spool 214 is slideably disposed within the cavity 219 of the respective housing 212. An outer diameter of the spool 214 preferably is the same as an inner diameter of the housing 212. The spool 214 forms its own cavity 222. Like the housing 212, one end of the cavity 219 is closed. The closed end of the spool 214 faces the solenoid assembly 218, while the open end of the spool 214 faces the closed end of the housing 212.

The advance or delay side passage 180, 182 can be selectively connected to the fluid supply passage 191 with the other one of the advance and delay side passages 180, 182 selectively connected to the fluid return passage 192 in accordance with a slide position of the spool 214. That is, the advance side passage 180 is connected to the fluid supply passage 191 when the delay side passage 182 is connected to the fluid return passage 192 and vice versa.

The housing 212 preferably defines a first circular recess 224, a second circular recess 226 and a third circular recess 228 on the inner surface of the cavity 219. In the illustrated embodiment, the first recess 224 is the farthest from the solenoid assembly 218 and communicates with the advance side passage 180. The second recess 226 is positioned between the first and third recesses 224, 228 and communicates with the fluid supply passage 191. The third recess 228 is positioned closest to the solenoid assembly 218 and communicates with the delay side passage 182.

The spool 214 preferably defines a first path 232, a second path 234 and a fourth circular recess 236. Preferably, each of the first and second paths 232, 234 comprises a circular recess and a through-hole that extends between a respective bottom of the circular recess and an inner surface of the spool 214. The advance side passage 180 can communicate with the cavity 228 of the spool 214 through the first path 232. Also, the delay side passage 182 can communicate with the cavity 228 of the spool 214 through the second path 234. In the illustrated arrangement, the fluid return passage 192 communicates with the cavity 228 of the spool 214 through an opening 238 that is formed at a portion of the housing 212 farthest from the solenoid assembly 218. Thus, the advance and delay side passages 180, 182 can communicate with the fluid return passage 192 through the first and second paths 232, 234, the cavity 228 of the spool 214 and the opening 238 of the housing 212. The fluid from either the advance or delay side spaces 170*a*, 170*b* that is not pressurized (as well as any leaked fluid) can return to the fluid reservoir through the fluid return passage 192.

The fourth circular recess 236 is positioned between the first and second paths 232, 234 and communicates with the fluid supply passage 191 through an opening 239 that is formed at a portion of the housing 212. Because the fourth circular recess 236 faces the second circular recess 226 of the housing 212 and is wider than the second circular recess 226, the advance and delay side passage 180, 182 can selectively communicate with the fluid supply passage 191 through the fourth circular recess 236 and the first or third circular recess 224, 228 which is coupled with the fourth circular recess 236.

As thus described, the recesses 224, 226, 228, 236 and the recesses defining the paths 232, 234 with the openings are connected or disconnected with each other. Accordingly, at least the housing 212 and the spool 214 in this embodiment together form a spool valve.

The bias spring 200 is disposed within the housing 212 and positioned between the closed end of the housing 212 and the open end of the spool 214 to urge the spool 214 toward the solenoid assembly 218. The spool 214 thus stays at its initial position that is shown in FIG. 10 unless the solenoid assembly 218 actuates the spool 214.

The solenoid assembly 218 comprises a solenoid coil 240 and an actuator 242 that pushes the spool 214 against the bias force of the spring 216 when the solenoid coil 240 is energized. The ECU energizes the solenoid coil 240 and moves the actuator 242 to set the spool 214 among delay, neutral and advance modes. The delay mode corresponds to the initial position of the spool 214 shown in FIG. 10. The neutral mode is shown in FIG. 9 and the advance mode is shown in FIG. 11.

In the neutral mode of FIG. 9, the advance side passage 180 does not communicate with either the fluid supply passage 191 or the fluid return passage 192 because the first circular recess 224 is closed by the spool 214. Also, the delay side passage 182 does not communicate with either the fluid supply passage 191 or the fluid return passage 192 because the third circular recess 228 is closed by the spool 214. In this neutral mode, the fluid in the respective advance and delay side spaces 170*a*, 170*b* of the change mechanism 150 is maintained to keep the angular position of the respective camshaft 106.

In the delay mode of FIG. 10, the delay side passage 182 communicates with the fluid supply passage 191 and the advance side passage 180 communicates with the fluid return passage 192. In this delay mode, the fluid in the respective delay side spaces 170*b* of the change mechanism 150 increases and the fluid in the respective advance side spaces 170*a* decreases. The angular position of the respective camshaft 106 thus is changed toward the fully delayed position.

In the advance mode of FIG. 11, the advance side passage 180 communicates with the fluid supply passage 191 and the delay side passage 182 communicates with the fluid return passage 192. In this advance mode, the fluid in the respective advance side spaces 170*a* of the change mechanism 150 increases and the fluid in the respective delay side spaces 170*b* decreases. The angular position of the respective camshaft 106 thus is changed toward the fully advanced position.

Although not shown, at least one camshaft position sensor is provided at one of the intake camshafts 106 to detect an actual position of the associated intake camshaft 106. The ECU monitors an output signal from the camshaft position sensor to control the VVT system 140.

With reference to FIGS. 4, 5 and 9–11, initially and when the engine 32 is at a standstill, the rotor 156 of the change mechanism 150 is placed at the fully delayed position and locked in this position by the lock unit 194 as described above. Under the initial condition, the control valve unit 140 is the delay mode of FIG. 10 because the solenoid coil 240 is not activated and the spool 214 is urged to the position by the bias spring 216.

If the engine 32 needs to advance the angular position of the respective camshafts 106, the ECU activates the solenoid coil 240 of the respective control valve units 178. The respective actuator 242 fully moves (to the left-hand side in the illustrated embodiment) and pushes the spool 214 to the position shown in FIG. 11. The respective control valve unit 152 now is in the advance mode. The advance side passage 180 is connected to the fluid supply passage 191 and the delay side passage 182 is connected to the fluid return passage 192. The fluid is delivered to the advance side spaces 170*a* of the change mechanism 150 through the advance side passage 180 by the lubricant pump. The fluid in the delay side spaces 170*b* returns to the fluid reservoir through the delay side passage 182. Because the lock pin 196 is pushed back into the guide member 198 by the fluid pressure, the rotor 156 rotates to change the angular position of the associated intake camshaft 106 toward the fully advanced position.

When the angular position of the respective intake camshafts 106 comes to a desired position, the ECU controls the respective solenoid coil 240 to move the actuator 242 (to the right-hand side as illustrated). The spool 214 also moves to the right-hand side as shown in FIG. 9 but does not fully move to the initial position because the solenoid coil 240 is still activated to keep the actuator in the halfway position. The control valve unit 152 now is in the neutral mode. The advance side passage 180 is disconnected from the fluid supply passage 191. Also, the delay side passage 182 is disconnected from the fluid return passage 192. The fluid in both of the advance side and delay side spaces 170*a*, 170*b* is maintained and the rotor 156 stops at the particular position to keep the associated intake camshaft 106 at the particular angular position.

If the engine 32 needs to delay the angular position of the respective camshafts 106, the ECU deactivates the respective solenoid coils 240. The respective actuator 242 fully moves (to the right-hand side as illustrated) and the spool 214 returns back to the initial position as shown in FIG. 10 because of the urging force of the bias spring 216. The respective control valve unit 152 is back in the delay mode. The delay side passage 182 is connected to the fluid supply passage 191 and the advance side passage 180 is connected to the fluid return passage 192. The fluid is delivered to the delay side spaces 170*b* of the change mechanism 150 through the advance side passage 180 by the lubricant pump. The fluid in the advance side spaces 170*a* returns to the fluid reservoir through the advance side passage 180. The rotor 156 rotates to change the angular position of the associated intake camshaft 106 toward the fully delayed position.

When the intake camshafts 106 reach at a desired delay position, the ECU controls the respective solenoid assemblies 218 to bring the respective control valve units 178 to the neutral mode of FIG. 9 again. The change mechanism 150 keeps the angular position of the associated intake camshaft 106 at the desired delayed position.

The VVT system 140 preferably repeats the operations described above in as much as the engine 32 operates. When the engine 32 is stopped, the respective change mechanism 150 returns to the initial state and the lock pin 196 locks the rotor 156 at the fully delayed position. Also, the respective control valve unit 152 returns to the delay mode.

In the illustrated embodiment, the engine can be compact even though the control valve units of the VVT system are provided as a part of the engine. This is because the large part of the control valve units is disposed within the top area of the cylinder head members where at least the portion of the camshaft drive mechanism such as a portion of the timing chain is disposed. That is, the camshaft drive mechanism is likely to occupy a large portion of the top area; however, unused space also is created in the top area. In the illustrated arrangement, the respective control valve unit is disposed in this unused space.

The illustrated control valve unit extends generally along the top surface of the cylinder head member and also is positioned generally at the same level as the timing belt. Thus, the control valve unit does not protrude upwardly. This arrangement also can contribute toward to making the engine smaller.

In addition, the internal passages extending within the cylinder head members further contribute to making the engine smaller.

The solenoid assembly of the respective control valve unit extends beyond the top area in the illustrated embodiment. However, because of its position just above the base block of the respective intake manifold, the solenoid assembly does not increase the size of the engine larger.

The respective change mechanism can be associated with the exhaust camshaft instead of the intake camshaft. Also, the valve cam mechanism can have a single camshaft instead of the double camshafts (i.e., the intake and exhaust camshaft). In this alternative, the change mechanism is associated with the single camshaft.

Although this invention has been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the invention have been shown and described, other modifications, which are within the scope of this invention, will be readily apparent to those of skill in the art based upon this disclosure. It is also contemplated that various combination or sub-combinations of the specific features and aspects of the embodiments or variations may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. An internal combustion engine comprising an engine body having an outer surface that defines an outer area next thereto, an output shaft extending through the engine body, an air intake system arranged to deliver air to a combustion chamber of the engine, the air intake system having an intake valve movable between a closed position at which the air is not allowed to move to the combustion chamber and an open position at which the air is allowed to move to the combustion chamber, an exhaust system arranged to route exhaust gases in the combustion chamber to an external location of the engine, the exhaust system having an exhaust valve movable between a closed position at which the exhaust gases are not allowed to move to the external location and an open position at which the exhaust gases are allowed to move to the external location, at least one camshaft actuating the intake valve or the exhaust valve, the camshaft extending through the engine body and toward the outer area beyond the outer surface, a drive mechanism arranged to drive the camshaft, at least a portion of the drive mechanism being disposed in the outer area, a hydraulically operated change mechanism arranged to change an angular position of the camshaft relative to the output shaft, and a control valve unit configured to control the change mechanism, the control valve unit comprising an actuator and a valve member, the valve member at least in part being disposed within the outer area and above a cylinder head member, which forms at least a portion of the combustion chamber.

2. The engine as set forth in claim 1, wherein the drive mechanism comprises a flexible transmitter extends around the output shaft and the camshaft such that the output shaft drives the camshaft through the transmitter, the control valve unit is disposed next to the transmitter.

3. The engine as set forth in claim 2, wherein the transmitter forms a loop, the control valve unit is disposed out of the loop.

4. The engine as set forth in claim 1 additionally comprising a fluid passage through which a hydraulic working fluid moves between the control valve unit and the change mechanism, the engine body having a member defining the outer surface, the member internally forms at least a portion of the fluid passage.

5. The engine as set forth in claim 1, wherein the control valve unit has a longitudinal axis that extends generally along the outer surface.

6. The engine as set forth in claim 1, wherein the control valve unit is positioned generally at the same level as the drive mechanism from the outer surface.

7. The engine as set forth in claim 6, wherein the drive mechanism comprises a flexible transmitter extends around the output shaft and the camshaft such that the output shaft drives the camshaft through the transmitter, the control valve unit is positioned generally at the same level as the transmitter.

8. The engine as set forth in claim 1, wherein the output shaft and the camshaft extend generally vertically, the outer surface is a top surface that extends generally horizontally, the outer area is a top area that extends generally above the top surface.

9. The engine as set forth in claim 1, wherein the camshaft actuates the intake valve.

10. The engine as set forth in claim 1, wherein the engine powers a marine propulsion device.

11. An internal combustion engine comprising an engine body having an outer surface that defines an outer area next thereto, an output shaft extending through the engine body, an air intake system arranged to deliver air to a combustion chamber of the engine, the air intake system having an intake valve movable between a closed position at which the air is not allowed to move to the combustion chamber and an open position at which the air is allowed to move to the combustion chamber, an exhaust system arranged to route exhaust gases in the combustion chamber to an external location of the engine, the exhaust system having an exhaust valve movable between a closed position at which the exhaust gases are not allowed to move to the external location and an open position at which the exhaust gases are allowed to move to the external location, at least one camshaft actuating the intake valve or the exhaust valve, the camshaft extending through the engine body and toward the outer area beyond the outer surface, a drive mechanism arranged to drive the camshaft, at least a portion of the drive mechanism being disposed in the outer area, a hydraulically operated change mechanism arranged to change an angular position of the camshaft relative to the output shaft, and a control valve unit configured to control the change mechanism, the control valve unit at least in part being disposed within the outer area, wherein the intake system comprises an intake conduit through which the air flows, the intake conduit has a portion coupled with the engine body, at least a portion of the control valve unit extends out of the outer area, the portion of the control valve unit overlaps with the portion of the intake conduit in a view generally normal to the outer surface.

12. The engine as set forth in claim 11, wherein the engine body having a member that defines the outer surface, the portion of the intake conduit is coupled with the member.

13. The engine as set forth in claim 12, wherein the engine body comprises a cylinder head member that forms a portion of the combustion chamber, the cylinder head member is the member that defines the outer surface.

14. An internal combustion engine comprising an engine body having an outer surface that defines an outer area next thereto, an output shaft extending through the engine body, an air intake system arranged to deliver air to a combustion chamber of the engine, the air intake system having an intake valve movable between a closed position at which the air is not allowed to move to the combustion chamber and an open position at which the air is allowed to move to the combustion chamber, an exhaust system arranged to route exhaust gases in the combustion chamber to an external location of the engine, the exhaust system having an exhaust valve movable between a closed position at which the exhaust gases are not allowed to move to the external location and an open position at which the exhaust gases are allowed to move to the external location, at least one camshaft actuating the intake valve or the exhaust valve, the camshaft extending through the engine body and toward the outer area beyond the outer surface, a drive mechanism arranged to drive the camshaft, at least a portion of the drive mechanism being disposed in the outer area, a hydraulically operated change mechanism arranged to change an angular position of the camshaft relative to the output shaft, and a control valve unit configured to control the change mechanism, the control valve unit at least in part being disposed within the outer area, wherein the engine body is configured as a V-shape to have a pair of cylinder banks, each cylinder bank has the camshaft, the change mechanism and the control valve unit, the intake system comprises a pair of intake conduits through which the air flows, each intake conduit has a portion coupled with the engine body, at least a portion of each control valve unit extends out of the respective outer area, the respective portion of each control valve unit overlaps with the respective portion of each intake conduit in a view generally normal to the outer surfaces.

15. An internal combustion engine for an outboard motor comprising an engine body having at least an outer surface that defines an outer area next to thereto, an output shaft extending generally vertically through the engine body, an air intake system arranged to deliver air to a combustion chamber of the engine, the air intake system having an intake valve movable between a closed position at which the air is not allowed to move to the combustion chamber and an open position at which the air is allowed to move to the combustion chamber, an exhaust system arranged to route exhaust gases in the combustion chamber to an external location of the engine, the exhaust system having an exhaust valve movable between a closed position at which the exhaust gases are not allowed to move to the external location and an open position at which the exhaust gases are allowed to move to the external location, at least one camshaft actuating the intake valve or the exhaust valve, the camshaft extending generally vertically through the engine body and toward the outer area beyond the outer surface, a drive mechanism arranged to drive the camshaft, at least a portion of the drive mechanism being disposed in the outer area, a hydraulically operated change mechanism arranged to change an angular position of the camshaft relative to the output shaft, and a control valve unit configured to control the change mechanism, the control valve unit at least in part being disposed within the outer area, wherein the outer surface is a top surface of the engine body, and the outer area is a top area that extends generally above the top surface.

16. The engine as set forth in claim 15, wherein the intake system comprises an intake conduit through which the air flows, the intake conduit has a portion coupled with the engine body, at least a portion of the control valve unit extends out of the outer area, the portion of the control valve unit overlaps with the portion of the intake conduit in a top plan view generally normal to the top surface.

17. The engine as set forth in claim 15, wherein the control valve unit comprises a spool valve that has a longitudinal axis that extends generally horizontally along the outer surface.

18. An internal combustion engine comprising an engine body comprising a cylinder head member that forms a portion of a combustion chamber, the cylinder head member having an outer surface, a generally vertically extending output shaft extending through the engine body, an air intake system arranged to deliver air to a combustion chamber of the engine, the air intake system having an intake valve movable between a closed position and an open position, an exhaust system arranged to route exhaust gases in the combustion chamber to an external location of the engine, the exhaust system having an exhaust valve movable between a closed position and an open position, at least generally vertically extending camshaft actuating the intake valve or the exhaust valve, the camshaft extending through the engine body and beyond the outer surface, a drive mechanism arranged to drive the camshaft, at least a portion of the drive mechanism being disposed beyond the outer surface, a hydraulically operated change mechanism arranged to change an angular position of the camshaft relative to the output shaft, and a control valve unit configured to control the change mechanism, the control valve unit comprising an actuator and a valve member, the valve member being disposed along and above the outer surface.

* * * * *